US011547926B2

(12) United States Patent
Basar

(10) Patent No.: US 11,547,926 B2
(45) Date of Patent: Jan. 10, 2023

(54) ROLLER BOARD

(71) Applicant: Volkan Basar, Mannheim (DE)

(72) Inventor: Volkan Basar, Mannheim (DE)

(73) Assignee: Sait Basar, Cologne (DE)

( * ) Notice: Subject to any disclaimer, the term of this patent is extended or adjusted under 35 U.S.C. 154(b) by 0 days.

(21) Appl. No.: 17/283,447

(22) PCT Filed: Sep. 12, 2019

(86) PCT No.: PCT/EP2019/074423
§ 371 (c)(1),
(2) Date: Apr. 7, 2021

(87) PCT Pub. No.: WO2020/074208
PCT Pub. Date: Apr. 16, 2020

(65) Prior Publication Data

US 2021/0339115 A1 Nov. 4, 2021

(30) Foreign Application Priority Data

Oct. 11, 2018 (DE) ..... 20 2018 105 819.3

(51) Int. Cl.
*A63C 17/01* (2006.01)
*A63C 17/12* (2006.01)
(Continued)

(52) U.S. Cl.
CPC ..... *A63C 17/012* (2013.01); *A63C 17/016* (2013.01); *A63C 17/12* (2013.01);
(Continued)

(58) Field of Classification Search
CPC ..... A63C 17/01; A63C 17/016; A63C 17/04; A63C 17/06
See application file for complete search history.

(56) References Cited

U.S. PATENT DOCUMENTS 3,389,922 A 6/1968 Eastin
5,893,425 A 4/1999 Finkle
(Continued)

FOREIGN PATENT DOCUMENTS

DE 101 00 072 B4 8/2004
DE 600 19 568 T2 2/2006
(Continued)

OTHER PUBLICATIONS

Search Report dated Apr. 24, 2019 in DE Application No. 20 2018 105 819.3.
(Continued)

*Primary Examiner* — Brian L Swenson
(74) *Attorney, Agent, or Firm* — Panitch Schwarze Belisario & Nadel LLP

(57) ABSTRACT

A roller board has axles provided with castors and secured at the front and rear ends of a board deck such that a steering movement is transferrable to the axles by a person on the board deck by lateral shifting of weight. Steerability and problem-free operation are improved. Substantially rigid booms, one directed to the front and one directed to the rear, are provided at the front and rear ends of the board deck, respectively. A support arm pointing in the direction of the central axis of the board deck is rigidly fastened to each boom. The support arms are pivotable on the two sides about a pivot axis inclined in the direction of travel by 40° to 50° relative to the plane of the board deck. The axle of a single castor is mounted rotatably in or on each hub, with the pivot joint inside the castor.

16 Claims, 10 Drawing Sheets

Figure 1:
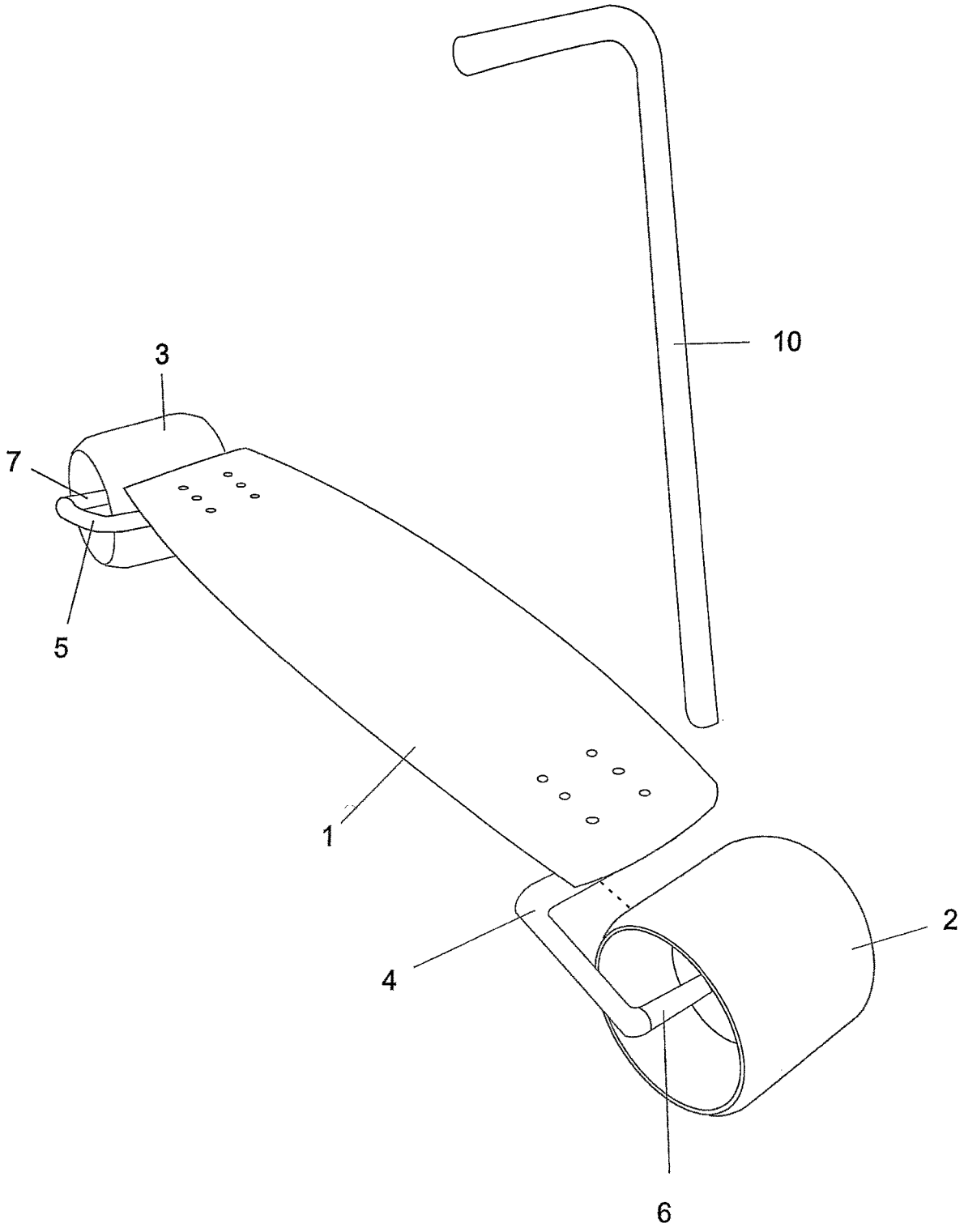

(51) Int. Cl.
*A63C 17/22* (2006.01)
*A63C 17/26* (2006.01)

(52) U.S. Cl.
CPC ..... *A63C 17/223* (2013.01); *A63C 17/226* (2013.01); *A63C 17/265* (2013.01); *A63C 2203/12* (2013.01); *A63C 2203/22* (2013.01)

(56) References Cited

U.S. PATENT DOCUMENTS

| | | | | |
|---|---|---|---|---|
| 6,241,264 | B1 | 6/2001 | Page | |
| 6,832,765 | B1 * | 12/2004 | Walton | A63C 17/223 280/11.221 |
| 6,832,771 | B2 * | 12/2004 | Beck | A63C 17/265 280/87.041 |
| D774,961 | S * | 12/2016 | Allen | D21/423 |
| 2005/0230930 | A1 * | 10/2005 | Chung | A63C 17/1418 280/87.041 |
| 2011/0175310 | A1 * | 7/2011 | Lewis | A63C 17/016 280/87.042 |
| 2016/0107070 | A1 * | 4/2016 | Middleton | A63C 17/262 280/87.042 |
| 2017/0001683 | A1 * | 1/2017 | Gerencsér | B62M 6/80 |
| 2019/0382072 | A1 * | 12/2019 | Allen | A63C 17/012 |

FOREIGN PATENT DOCUMENTS

| | | | |
|---|---|---|---|
| DE | 20 2010 010 576 | U1 | 10/2010 |
| DE | 10 2010 034 908 | A1 | 2/2012 |
| DE | 10 2015 101 652 | A1 | 8/2016 |
| DE | 10 2013 207 517 | B4 | 12/2016 |
| DE | 10 2016 218 628 | A1 | 3/2018 |
| EP | 1 097 733 | A2 | 5/2001 |
| WO | 0054856 | A1 | 9/2000 |
| WO | 03045511 | A2 | 6/2003 |
| WO | 2016/005953 | A1 | 1/2016 |
| WO | 2018/175536 | A1 | 9/2018 |

OTHER PUBLICATIONS

Int'l Search Report dated Nov. 25, 2019 in Int'l Application No. PCT/EP2019/074423.

* cited by examiner

ROLLER BOARD

CROSS-REFERENCE TO RELATED APPLICATIONS

This application is a Section 371 of International Application No. PCT/EP2019/074423, filed Sep. 12, 2019, which was published in the German language on Apr. 16, 2020 under International Publication No. WO 2020/074208 A1, and which claims priority under 35 U.S.C. § 119(b) to German Patent Application No. 20 2018 105 819.3, filed on Oct. 11, 2018; and the disclosures of each application cited in this paragraph are incorporated herein by reference.

The invention concerns a roller board having an elongate board deck and axles which are arranged at the front and rear ends thereof and are provided with rollers and are fixed steerably to the board deck, wherein a steering movement can be transmitted to the axles by a lateral shift in weight by the person standing on the board deck.

Known roller boards of the specified kind are known in the category of "skateboard". In skateboards the axles provided at the front and rear ends each have two lateral wheels, on which it is possible to advance standing on the board by pushing against the ground with one leg or by means of a particular technique of alternately pressing both feet towards the outsides of the skateboard by a shift in weight.

DE 20 2010 010 576 U1 discloses for example a skateboard which by virtue of its material nature and configuration of the surface on which the skateboarder stands can be used specifically to permit deformability which upon a shift in weight results directly in a steering movement of the wheel axles fixed to the support surface of the board. The steering option is however severely limited with that structure.

DE 10 2010 034 908 A1 discloses a further skateboard which already has a flexible steering option for the axles. The return force which moves the axles back into the central position after a steering operation is applied by a metal torsion spring of which one limb is fixedly connected to the board deck while the other limb acts on the respective axle. Such a mechanism however is structurally relatively complicated and expensive and stiff to operate.

Therefore the object of the invention is to provide a roller board in the manner of a skateboard, which with very simple means permits improved steerability and less problematical operation.

According to the invention that object is attained in that:

- provided at the front and rear ends of the board deck is a respective substantially rigid cantilever arm which is directed forwardly and rearwardly respectively,
- a support arm facing in the direction towards the centre line of the board deck is rigidly fixed to each cantilever arm,
- provided on each support arm is a hub which is pivotable towards both sides about a pivot axis which is inclined in the direction of travel through 40° to 50°, preferably through about 45°, with respect to the plane of the board deck, and
- the axle of a single roller is mounted rotatably in or on each hub, wherein the pivot joint is in the interior of the respective roller.

By virtue of the novel steering mechanism the roller board according to the invention which differs considerably from known skateboards can be very easily steered by a shift in weight, wherein both the rear roller and also the front roller respectively pivots in to the side in question, which is pressed downwardly by the shift in weight of the operator.

In addition the two rollers which are arranged in front of and behind the board deck can be of a relatively large diameter, allow comfortable travel, in which case even with poor surfaces and minor obstacles which occur good travel performance is ensured.

The substantially rigid cantilever arms mounted in front of the front and behind the rear end of the board deck are desirably disposed on the same side of the board deck.

It is further possible for the angle of the cantilever arms to be designed to be adjustable in a vertical plane relative to the plane of the board deck so that it is possible to influence the height of the board deck above the ground and to influence the travel behaviour of the roller board.

The roller respectively provided at the front and rear end of the board deck can not only be of a relatively large diameter but is desirably also relatively wide, more specifically approximately as wide as the board deck so as to permit secure comfortable boarding. In that respect the outer edges of the rollers upon a shift in weight function as levers and steer the roller board in the desired direction.

The hub which is provided on each support arm and which serves to mount the respective roller can be hollow.

In a first embodiment the support arms are forked, wherein receiving bores are provided at the fork ends of the support arms while pins are provided at the inside of the hollow hubs, the pins engaging into the receiving bores in the fork ends. In that arrangement the axles of the rollers are mounted on the hubs. Alternatively it will be appreciated that as an equivalent the pins can also be provided at the fork ends while provided at the inside of the hollow hubs are receiving bores into which the pins on the fork ends engage.

In another embodiment the support arms which are also forked can have receiving bores at the fork ends while provided at the outside of the hubs are pins engaging into the receiving bores in the fork ends. In that case the axles of the rollers can be mounted in the hubs. In this embodiment also the pins and the receiving bores can be interchanged.

In a further embodiment provided at the outside of the axles is a respective steering head displaced through about 45° with respect to the board deck plane, wherein the steering heads are pivotably connected to the support arm.

In a further embodiment the end of the support arm is in the form of a ring embracing a transverse pin provided in the interior of the hub.

In a further embodiment of the invention a rolling bearing can be pivotably mounted on each support arm, wherein the inner race of the rolling bearing is pivotably connected to the support arm and forms the stationary hub while the outer race of the rolling bearing serves as a rotating axle of the roller.

In the last-mentioned embodiment desirably fixed to each support arm is a transverse pin which engages pivotably into radially opposite bores of the inner race of the rolling bearing.

Preferably ball bearings are used as the rolling bearings.

All embodiments of the roller board according to the invention can be provided at the front end of the board deck with a vertical removable handle, thereby ensuring more safety and comfort when boarding.

A motor can be arranged in the interior of at least one of the rollers, the output shaft of the motor driving the axle of the roller. In that case the motor can be actuated by way of a remote control or a controller provided on the handle.

Figure 2:
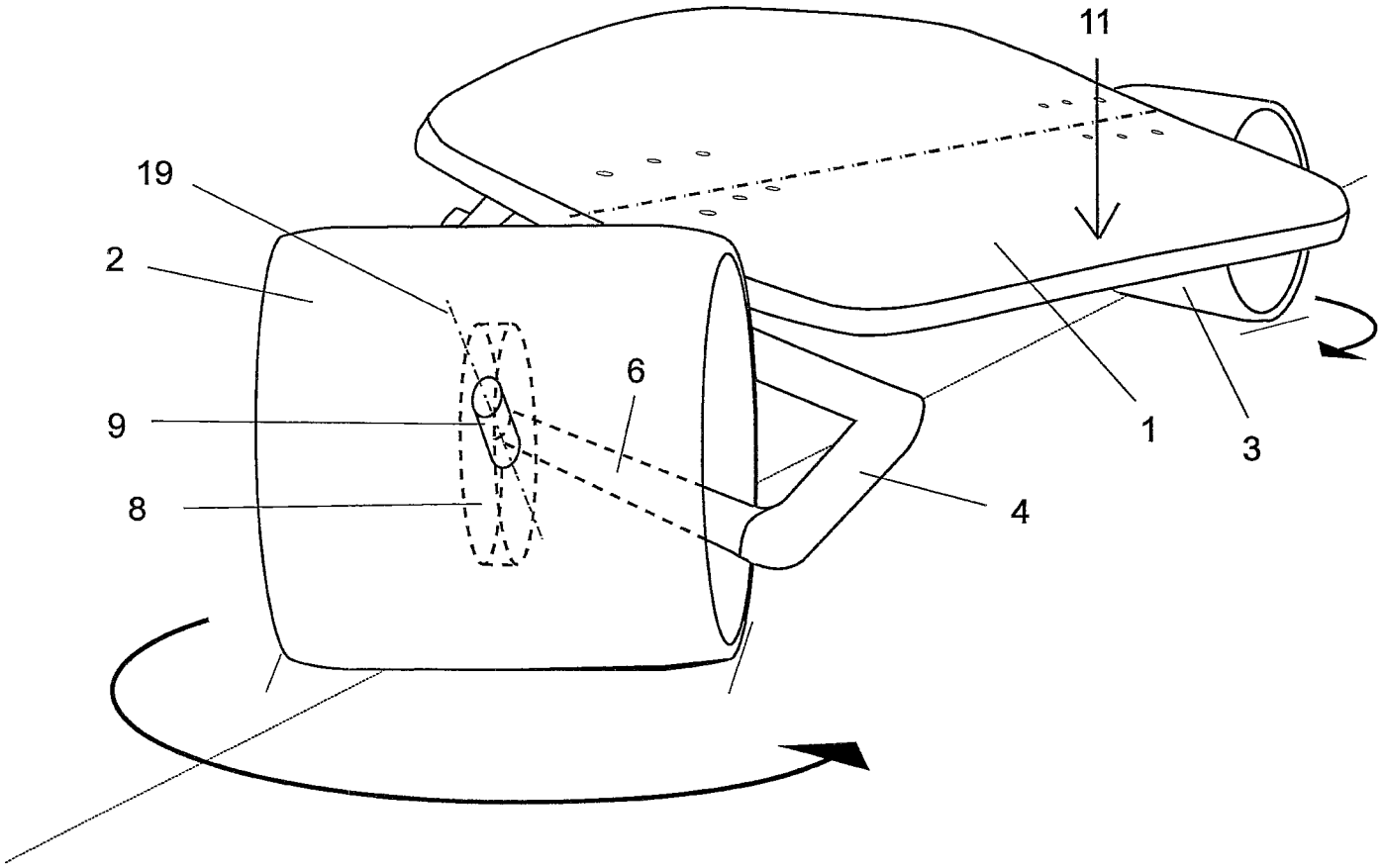
Figure 3:
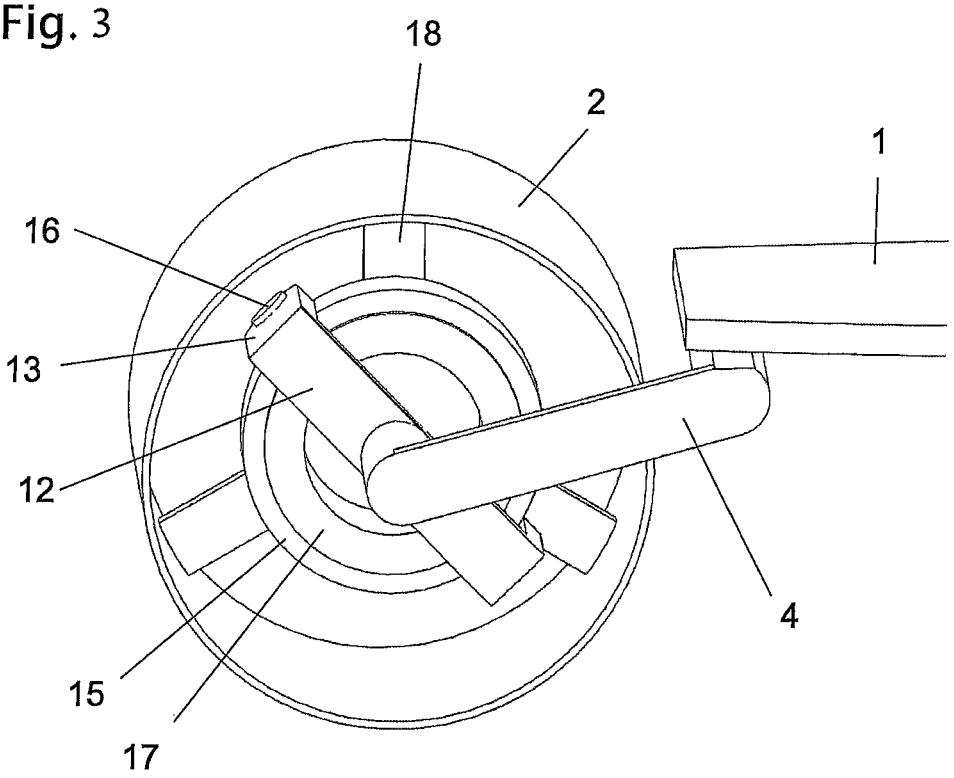
Figure 4:
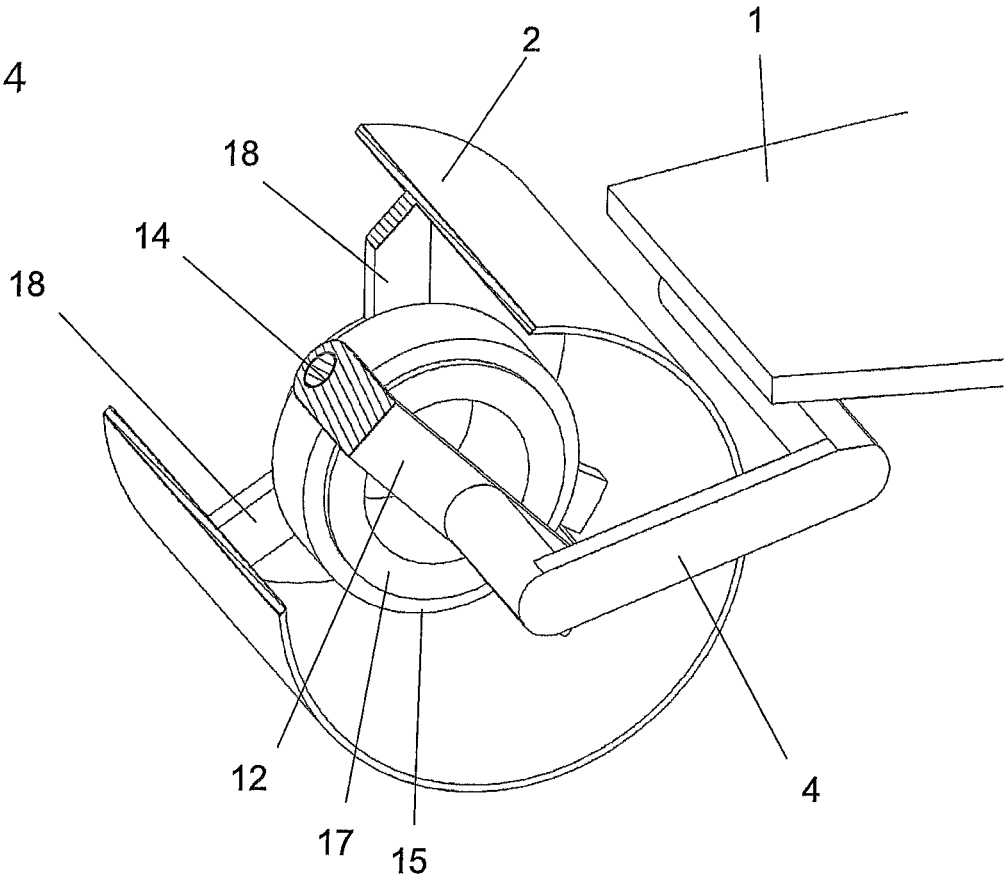
Figure 5:
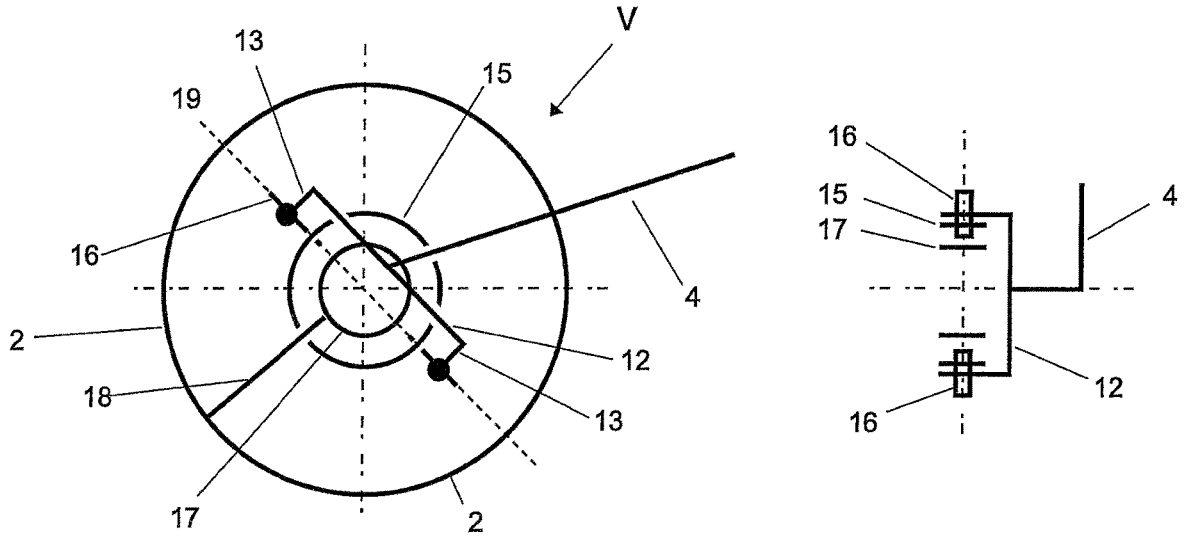
Figure 6:
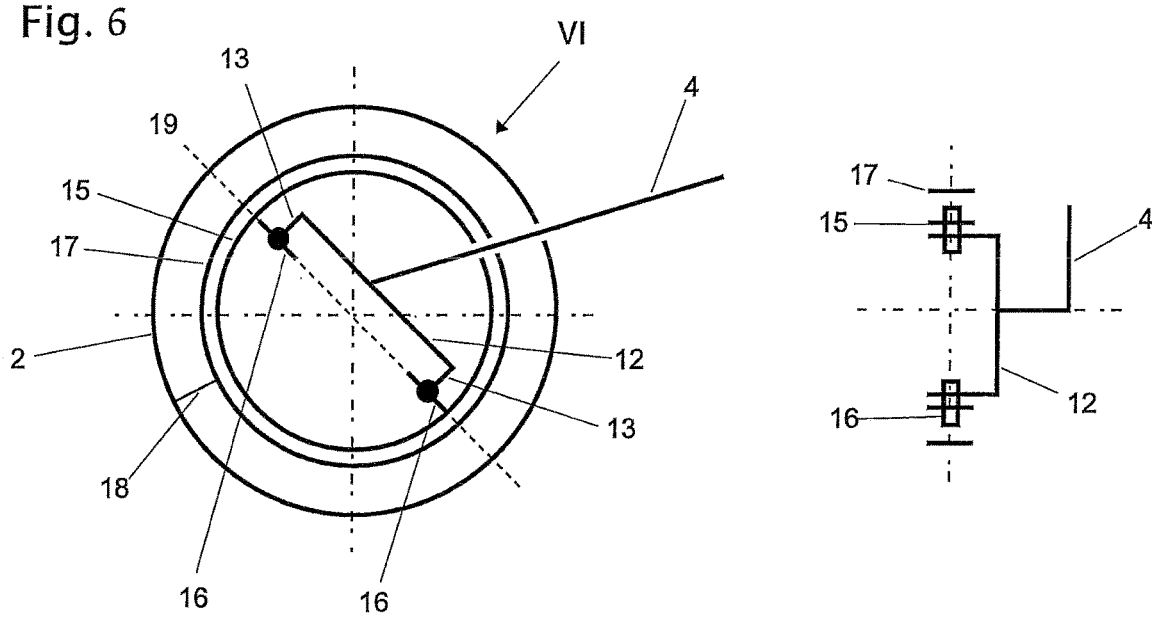
Figure 7:
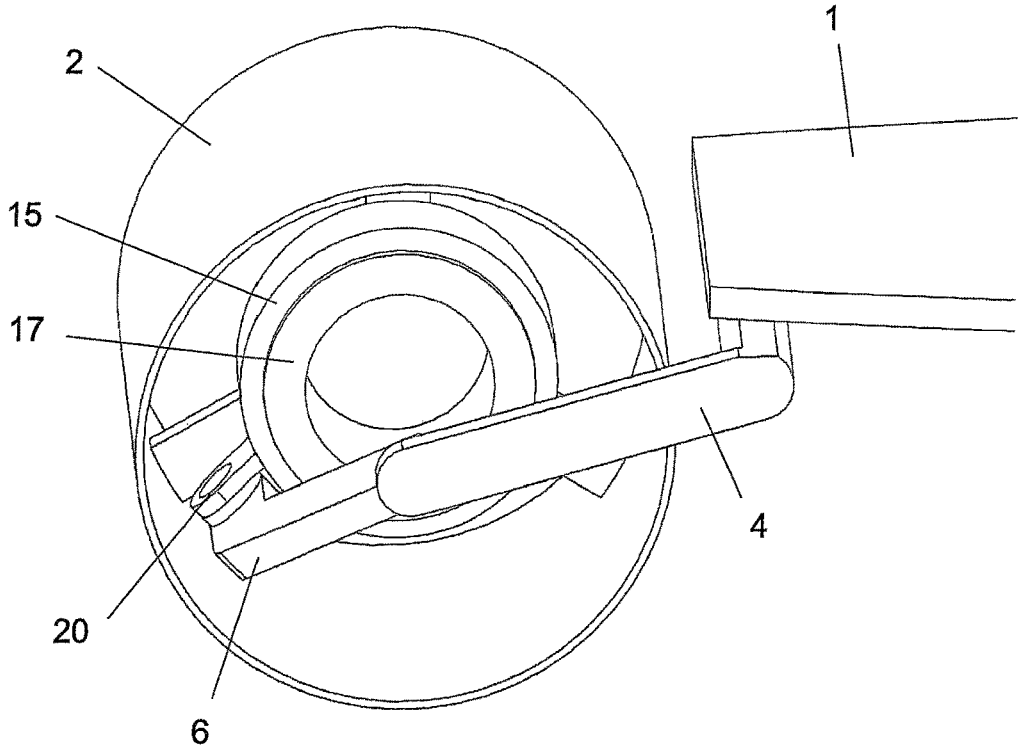
Figure 8:
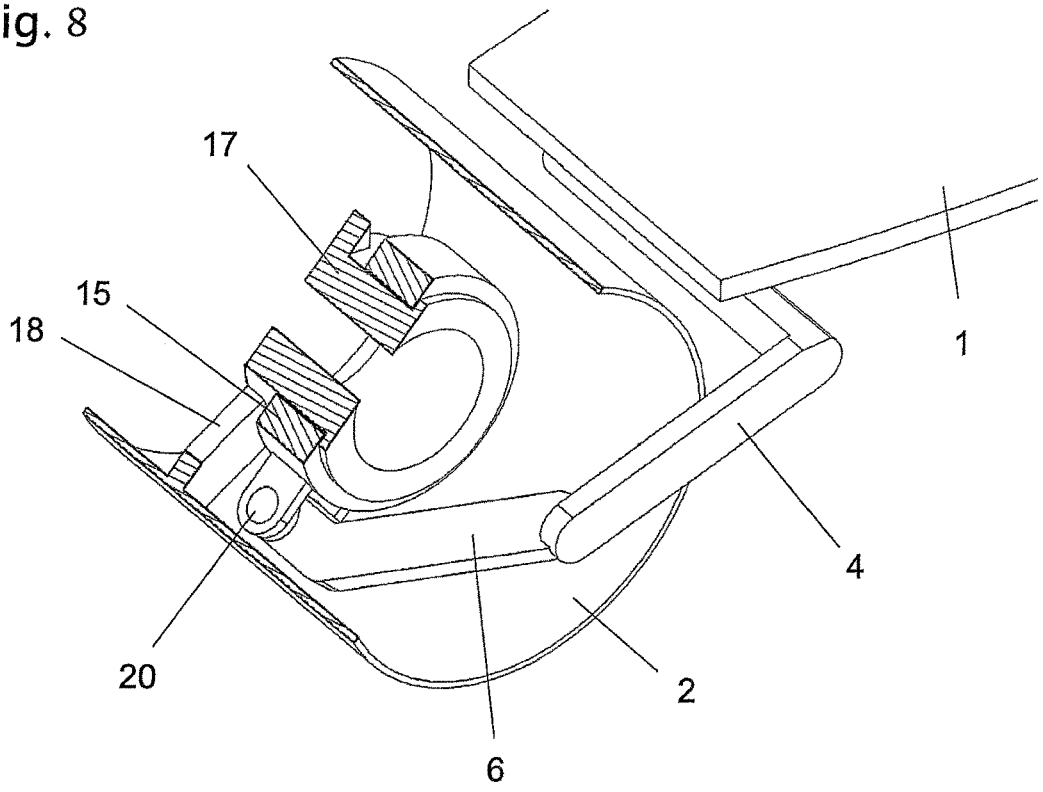
Figure 9:
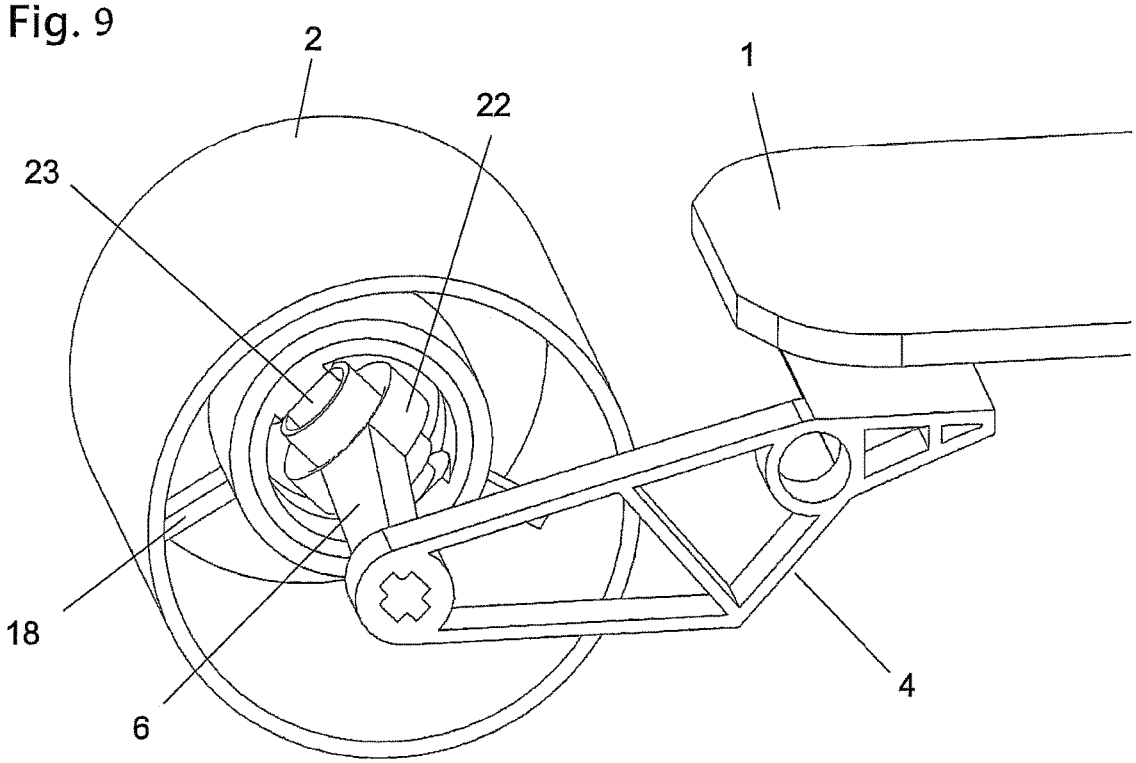
Figure 10:
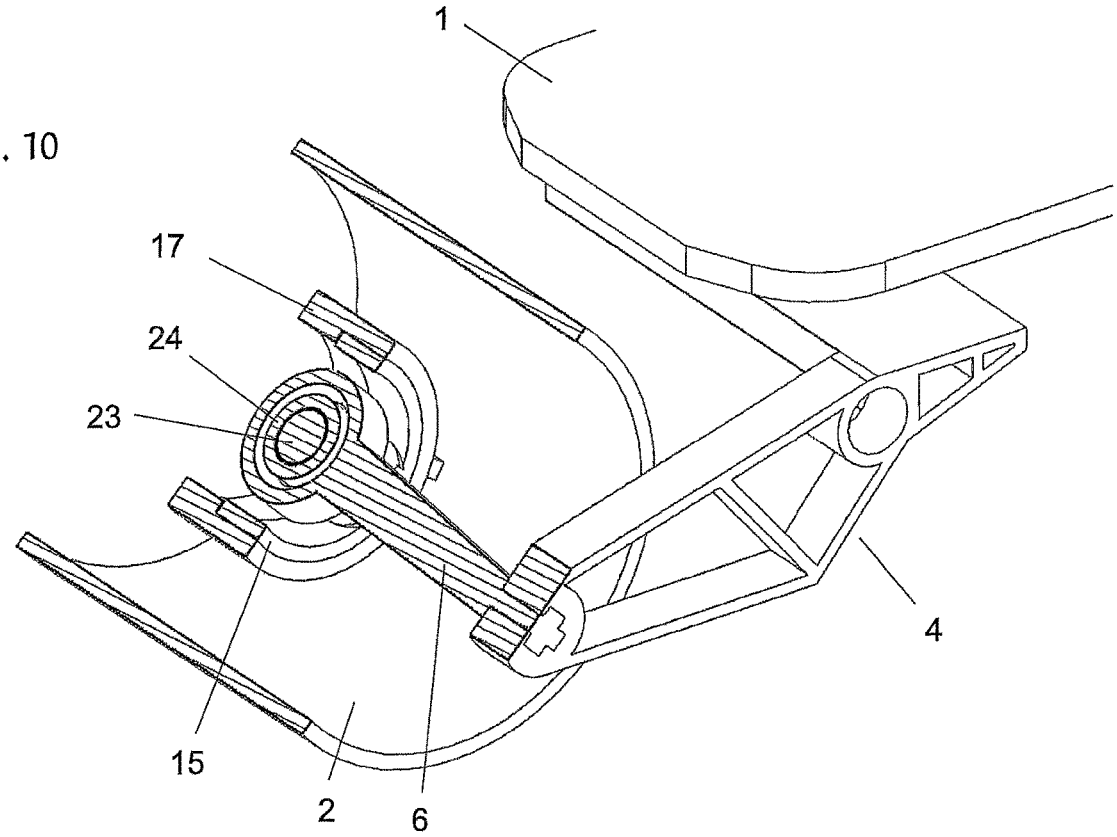
Figure 11:
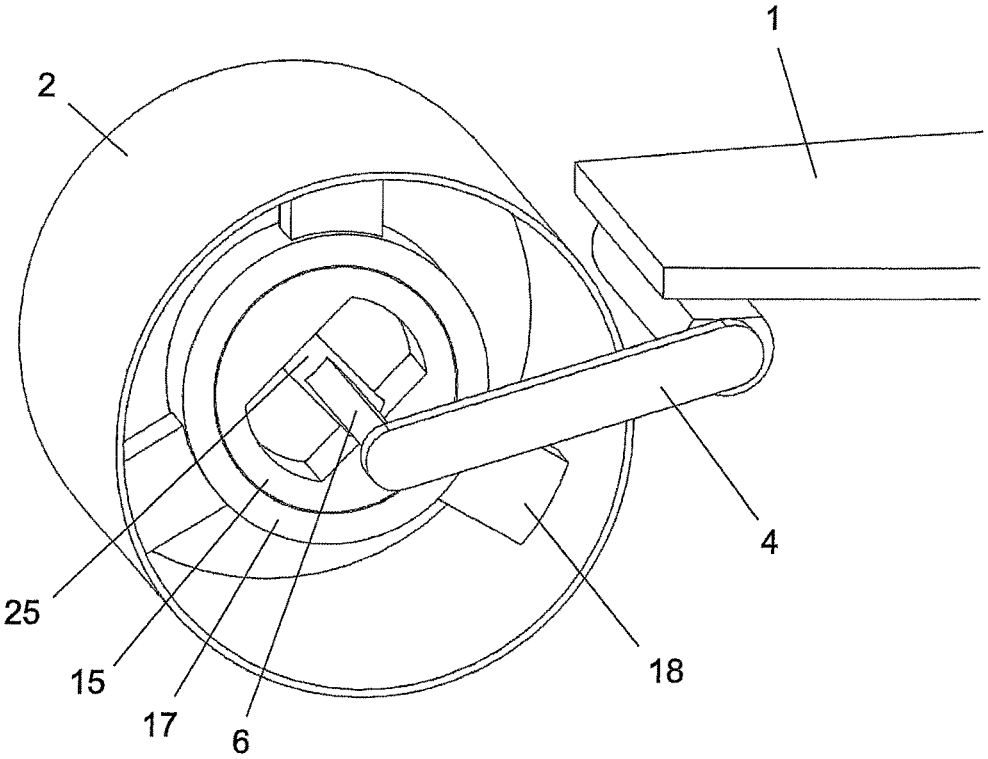
Figure 12:
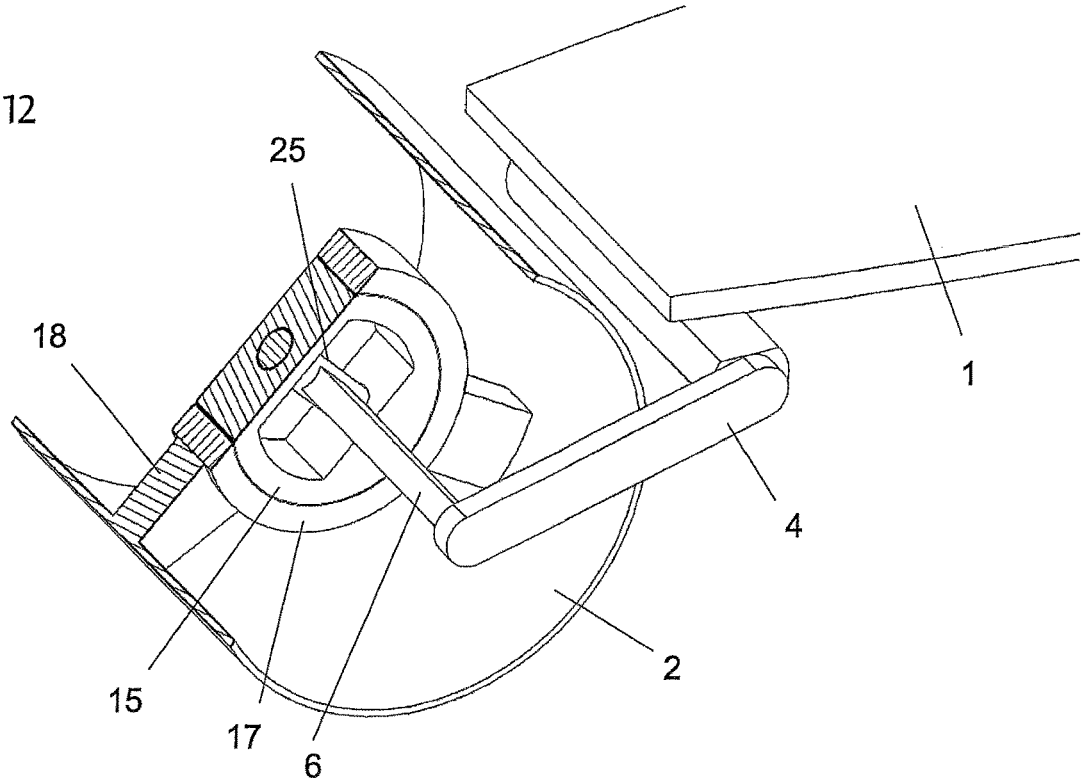
Figure 13:
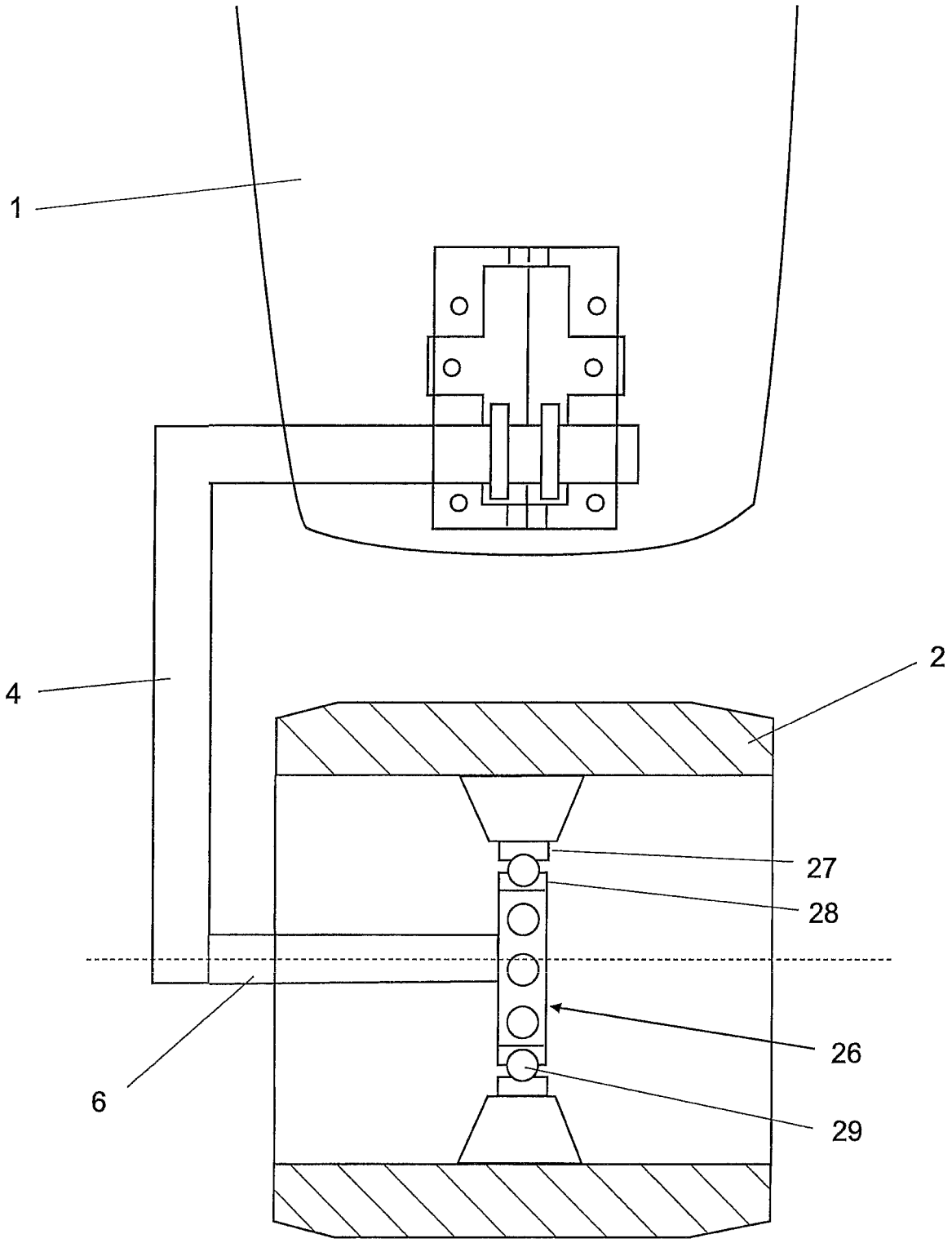
Figure 14:
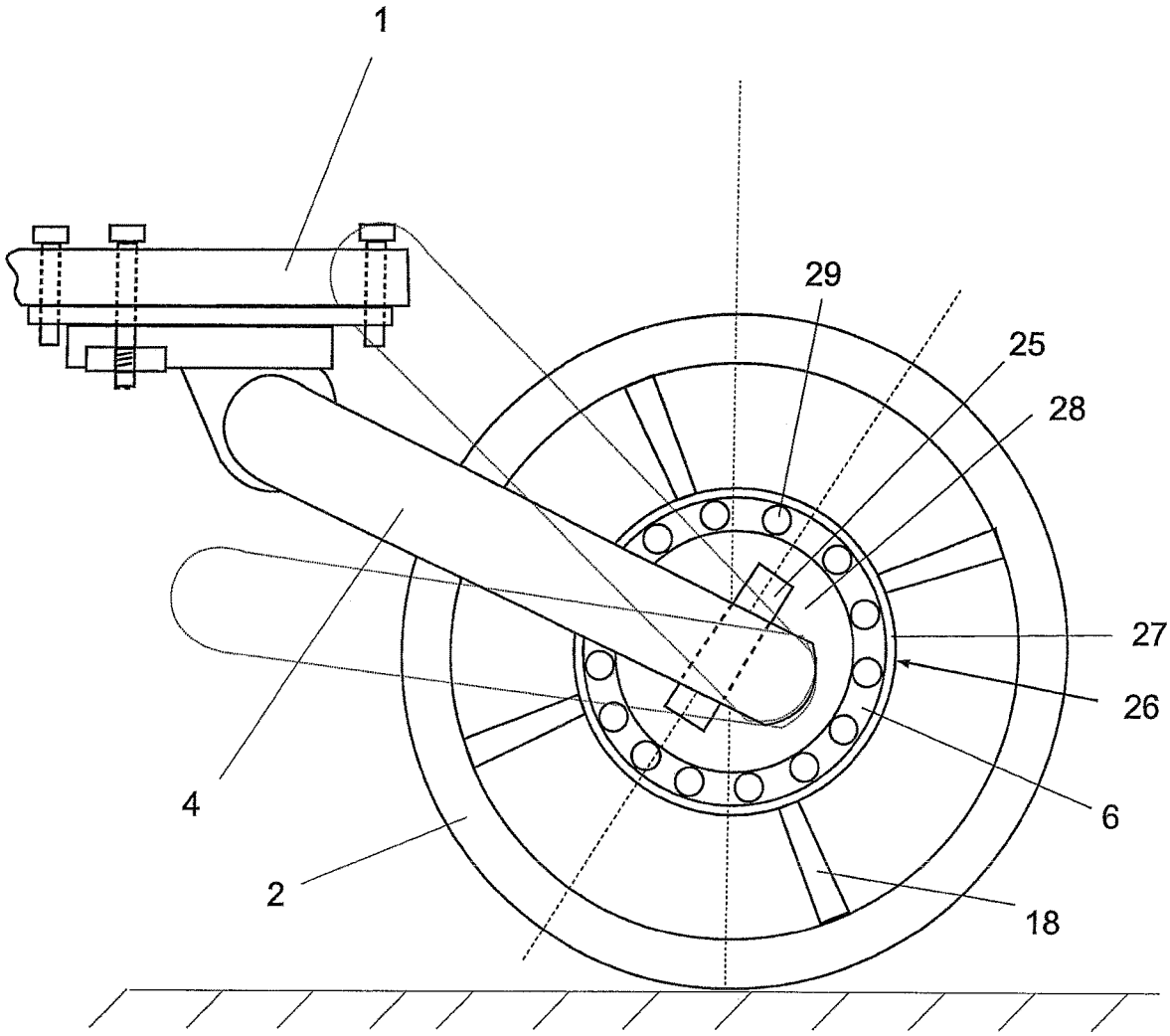
Figure 15:
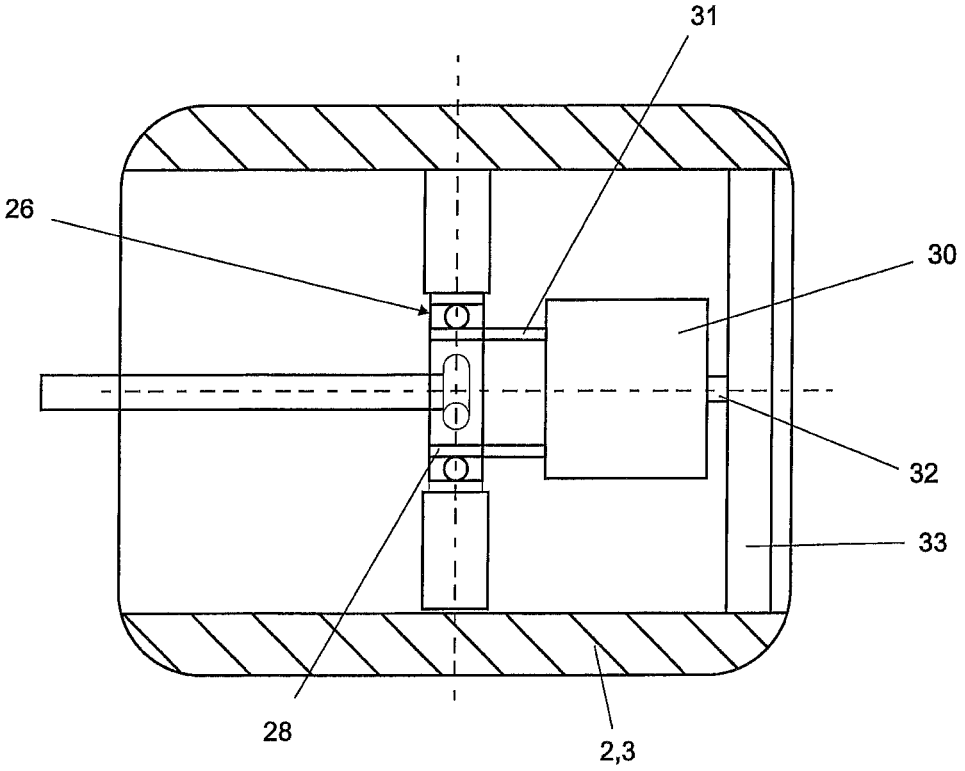
Figure 16:
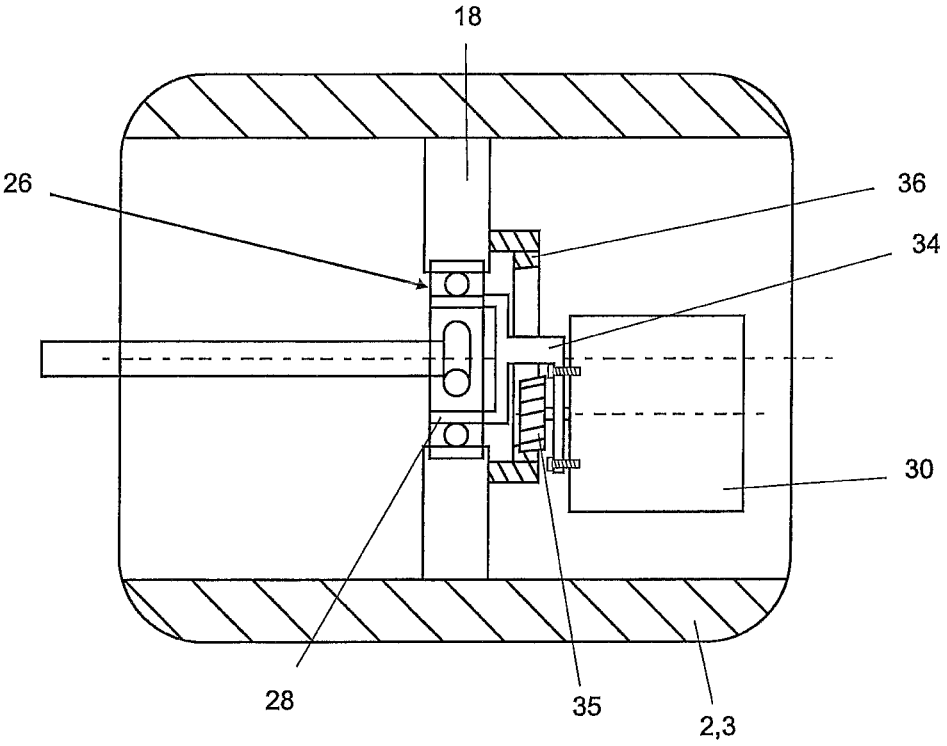

The invention is illustrated by way of example in the drawing and described in detail hereinafter with reference to the drawing in which:

FIG. 1 shows a perspective diagrammatic view of the roller board according to the invention, FIG. 2 shows a perspective view on an enlarged scale of the roller board with an inclined position of the board deck, FIGS. 3 and 4 show a first embodiment for the pivotable mounting of the hub, FIG. 5 shows a diagrammatic view of the embodiment of FIGS. 3 and 4, FIG. 6 shows a diagrammatic view of a second alternative embodiment for the pivotable mounting of the hub, FIGS. 7 and 8 show a third embodiment for the pivotable mounting of the hub, FIGS. 9 and 10 show a fourth embodiment for the pivotable mounting of the hub, FIGS. 11 and 12 show a fifth embodiment for the pivotable mounting of the hub, FIGS. 13 and 14 show a sixth embodiment with a pivotable mounting of the hub, in the form of a ball bearing, FIG. 15 shows an embodiment of a motor drive for the roller board, and FIG. 16 shows a further embodiment for a motor drive.

In FIGS. 1 and 2 of the drawing the roller board according to the invention comprises an elongate board deck 1 and rollers 2 and 3 arranged in front of and behind the front and rear ends thereof respectively.

To hold and mount the rollers 2 and 3 a respective forwardly and rearwardly oriented substantially rigid cantilever arm 4 and 5 is arranged at the front and rear ends respectively. A support arm 6 and 7 facing in the direction towards the centre line of the board deck 1 is rigidly fixed to each of the cantilever arms 4 and 5. In the illustrated embodiment the cantilever arms 4 and 5 are arranged on the same side of the board deck.

Provided on each of the two support arms 6 and 7 is a respective hub 8 which is pivotable towards both sides about a pivot axis 19 which is inclined through about 45° with respect to the plane of the board deck 1 in the travel direction, as diagrammatically shown in FIG. 2. In this case the hub 8 is connected to the respective support arm 6 and 7 by way of a pivot joint 9 in such a way that it is pivotable through about 25° in both directions in the plane of the board deck 1.

As can further be seen from FIG. 1 an approximately vertical holding handle 10 which reaches to the stomach height of the person standing on the board deck 1 can be provided at the front end of the board deck, which handle can be selectively fixed to or removed from the board deck 1. Safer and more comfortable travel can be achieved under some circumstances for the operator by the provision of the handle 10.

As can further be seen from FIGS. 1 and 2 a respective single roller 2 and 3 is provided at the front and rear ends of the board deck 1, which rollers are relatively wide and are preferably approximately of the width of the board deck 1. The rollers 2 and 3 are desirably cylindrical but deviations are possible, for example it is also possible to adopt a slightly crowned shape or a shape which is flattened off to the side edges. The cantilever arms 4 and 5 are substantially rigidly fixed to the board deck 1, although a slight pivotal movement can be achieved by virtue of the elasticity of the material used. There is however the possibility of adjusting the angle of the two cantilever arms 4 and 5 in a vertical plane relative to the plane of the board deck 1 so that the height position of the board deck 1 can be altered relative to the rollers 2 and 3.

As can be seen in particular from FIG. 2 a steering movement can be transmitted to the axles of the rollers 2 and 3 by a lateral shift in weight by a person standing on the board deck, in the direction of the arrow 11. When the board deck is inclined towards the left as shown in FIG. 2 then the front roller 2 also pivots towards the left and the rear roller 3 towards the right so that the roller board follows a left-hand curve.

Various embodiments for the pivot joints 9 between the support arms 6 and 7 respectively and the respective hub 8 are shown in the following Figures.

FIGS. 3 and 4 shows the front end of the board deck 1, to which the cantilever arm 4 is rigidly fixed. A forked support arm 12 is rigidly fixed at the free end of the cantilever arm 7, with receiving bores 14 being provided at the fork ends 13 of the support arm 12. The two fork ends 13 of the support arm 12 engage over a hollow hub 15, wherein provided at the outer periphery thereof on mutually opposite sides are pins 16 engaging into the receiving bores in the fork ends 13. In this case the axle 17 of the roller 2 is mounted in the interior of the hollow hub 13. The axle 17 is connected to the roller 2 by way of a plurality of struts 18 arranged distributed over the periphery.

The forked support arm 12 fixed rigidly to the cantilever arm 4 is arranged in such a way that a plane extending through the fork ends 13 is inclined through about 45° relative to the horizontal.

When therefore the board deck 1 is inclined towards the left as shown in FIG. 2 the hub 15 pivotably mounted to the forked support arm 12 also rotates somewhat towards the left and entrains the axle 17 and therewith the roller 2.

FIG. 5 again shows a diagrammatic view of the steering mechanism of the embodiment of FIGS. 3 and 4. In this respect it can be clearly seen that the pivot axis 19 extending in the direction of the pins 16 is inclined through about 45° to the vertical or horizontal.

Shown on the right-hand side of FIG. 5 is a diagrammatic view of the internal region of the pivot joint in the direction of the arrow V, from which it can be clearly seen that the forked support arm 12 engages over the hollow hub 15 and the hub 15 is mounted pivotably between the fork ends 13 by way of the pins 16 passing through the receiving bores 14.

FIG. 6 shows a similar steering mechanism to the embodiment of FIG. 5. The difference from the embodiment of FIG. 5 is that the fork ends 13 engage into the interior of the hollow hub 15 and by way of the pins 16 form a pivotable connection between the forked support arm 12 and the hub 15.

In this case the axle 17 of the roller 2 is mounted on the outer periphery of the hub 15 and connected to the roller 2 by way of struts 18. Shown on the right-hand side of FIG. 6 is a view of the central region of the roller 2 in the direction of the arrow VI.

FIGS. 7 and 8 show a further embodiment of the pivot joint for the roller 2. In this embodiment provided at the outside of the hollow hub 15 is a steering head 20 which is displaced through about 45° relative to the plane of the board deck. The steering head 20 is connected pivotably by way of a joint 21 to the support arm 6 arranged rigidly on the cantilever arm 4. The axle 17 of the roller 2 is mounted within the hollow hub 15, with the axle 17 being connected to the roller 2 by way of struts 18.

FIGS. 9 and 10 show a further embodiment of the pivot joint in the case of the front roller 2. In this arrangement the roller 2 is mounted to the cantilever arm 4 and the support arm 6. At its end which is in the interior of the roller 2 the support arm 6 has a ring 22 surrounding a mounting pin 23 extending transversely through the hub 15. A plain bearing sleeve 24 is provided between the ring 22 and the mounting pin 23.

The axle 17 of the roller 2 is mounted rotatably on the hub 15 and is connected to the roller 2 by way of struts 18. The mounting pin 23 is inclined at about 45° relative to the plane of the board deck 1.

FIGS. 11 and 12 show a further embodiment of the invention which is very similar in principle to the embodiment of FIGS. 9 and 10.

In this embodiment the support arm 6 on the cantilever arm 4 has at its end disposed in the interior of the roller 2 a transverse pin 25 fixedly connected thereto. The pin is in turn inclined through about 45° relative to the plane of the board deck 1. That transverse pin 25 serves as a pivot axis for the hub 15. Pivotability is achieved by the transverse pin 25 engaging into corresponding mounting bores provided in the inside wall of the hub 15.

The axle 17 of the roller is mounted rotatably on the hub 15 and connected to the roller 2 by way of struts 18.

FIGS. 13 and 14 show a further embodiment of the invention, more specifically in this case the pivot joint is constructed by means of a ball bearing 26, the ball bearing 26 having an outer race 27, an inner race 28 and a plurality of balls 29 between the two races.

The inner race 28 is pivotably mounted to the support arm 6 of the cantilever arm 4 by way of a transverse pin 25. The transverse pin 25 is again inclined through about 45° relative to the plane of the board deck 1 and connects the inner race 28 of the ball bearing 26 pivotably to the support arm 6.

In this case the inner race 28 of the ball bearing 26 forms the stationary hub while the outer race 27 serves as the rotating axle of the roller 2. The outer race 27 is connected to the roller 2 by way of struts 18.

FIGS. 15 and 16 show two embodiments for a drive of the roller 2 and 3 respectively. In the FIG. 15 embodiment the drive is a battery-driven motor 30 fixedly connected to the inner race 28 of the ball bearing 26 by way of a fixing member 31. The output shaft 32 of the motor 30 sets the roller 2 and 3 respectively in movement by way of a connecting element 33 fixedly arranged between the output shaft 32 and the roller 2 or 3.

In FIG. 16 the motor 30 is connected fixedly to the inner race 28 of the ball bearing 26 by way of a connecting element 34. Carried on the output shaft 32 of the motor 30 is a pinion 35 meshing with an internal gear 36. The internal gear 36 is rigidly connected to the roller 2 or 3 respectively by way of struts 18.

Actuation of the motor is effected by way of a remote control (not shown) or a switch on the handle 10.

The motor drive arrangement is not restricted to the embodiment shown in FIGS. 15 and 16 by means of ball bearings 26. The motor drive can also be used in all other above-described embodiments, with the motor 30 respectively driving the correspondingly provided axle of the roller 2 or 3 respectively.

LIST OF REFERENCES

1 board deck
2 front roller
3 rear roller
4 cantilever arm
5 cantilever arm
6 carrier arm
7 carrier arm
8 hub
9 pivot joint
10 handle
11 arrow
12 forked support arm
13 fork ends
14 receiving bores
15 hollow hub
16 pin
17 axle of the roller 2 and 3
18 strut
19 pivot axis
20 streering head
21 joint
22 ring
23 mounting pin
24 plain-bearing sleeve
25 transverse pin
26 ball bearing
27 outer race
28 inner race
29 balls
30 motor
31 fixing member
32 output shaft
33 connecting element
34 connecting element
35 pinion
36 internal gear

I claim:

1. A roller board having an elongate board deck (1), substantially rigid cantilever arms (4, 5) provided at front and rear ends of the board deck (1), and rollers (2, 3) which are arranged on the cantilever arms (4, 5) and are fixed to the cantilever arms (4, 5) in a steerable manner, wherein a steering movement can be transmitted to the rollers (2, 3) by a lateral shift in weight by the person standing on the board deck (1), wherein the cantilever arms at the front and rear ends of the board deck (1) are forwardly and rearwardly directed individual, laterally arranged cantilever arms (4, 5) respectively, a arm (6, 7; 12) facing in a direction towards the central line of the board deck (1) is rigidly fixed to each cantilever arm (4, 5), on each support arm (6, 7; 12) is a hub (8, 5) which is pivotable towards both sides about a pivot axis (19) which is inclined in the direction of travel through 40° to 50° with respect to the plane of the board deck (1), and an axle (17) of a single roller (2; 3) is mounted rotatably in or on each hub (8, 15), wherein the pivot joint (9) is located in the interior of the respective roller (2; 3).

2. A roller board according to claim 1 wherein the substantially rigid cantilever arms (4, 5) are arranged on the same side of the board deck (1).

3. A roller board according to claim 1 wherein the angle of the cantilever arms (4, 5) is adjustable in a vertical plane relative to the plane of the board deck (1).

4. A roller board according to claim 1 wherein the roller (2, 3) respectively provided at the front and rear ends of the board deck (1) is approximately as wide as the board deck (1).

5. A roller board according to claim 1 wherein the hubs (8, 15) are hollow.

6. A roller board according to claim 5 wherein the support arms (6, 7) are of a forked configuration, receiving bores (14) are provided at the fork ends (13) of the support arms (6, 7; 12), provided at the inside of the hollow hubs (8; 15) are pins (16) engaging into the receiving bores (14) in the fork ends (13), and the axles (17) of the rollers (2, 3) are mounted on the hubs (8; 15).

7. A roller board according to claim 1 wherein the support arms (6, 7; 12) are of a forked configuration, receiving bores (14) are provided at the fork ends (13) of the support arms (6, 7; 12), provided at the outside of the hubs (8; 15) are pins (16) engaging into the receiving bores (14) in the fork ends (13), and the axles (17) of the rollers (2, 3) are mounted in the hubs (8; 15).

8. A roller board according to claim 1 wherein provided at the outside of the axles (17) is a respective steering head (20) displaced through about 45° with respect to the board deck plane, and the steering heads (20) are pivotably connected to the support arm (6).

9. A roller board according to claim 1 wherein the end of the support arm (6, 7) is in the form of a ring (22) embracing a transverse pin (23) provided in the interior of the hub (15).

10. A roller board according to claim 1 wherein a rolling bearing is pivotably mounted on each support arm (6; 7), wherein the inner race (28) of the rolling bearing is pivotably connected to the support arm (6; 7) and forms the stationary hub while the outer race (27) of the rolling bearing serves as a rotating axle of the roller (2; 3).

11. A roller board according to claim 10 wherein fixed to each support arm (6) is a transverse pin (25) which engages pivotably into radially opposite bores of the inner race (28) of the rolling bearing.

12. A roller board according to claim 10 wherein ball bearings (26) are provided as the rolling bearings.

13. A roller board according to claim 1 wherein a vertical holding handle (10) is provided at the front end of the board deck (1), the handle being removably fixed.

14. A roller board according to claim 1 wherein arranged in the interior of the roller (2; 3) is a motor (30), the output shaft (32) of which drives the axle of the roller (2; 3).

15. A roller board according to claim 14 wherein the motor (30) is actuable by way of a remote controller or a controller provided on the handle (10).

16. A roller board according to claim 1 wherein the pivot axis (19) is inclined in the direction of travel by about 45°.

* * * * *